United States Patent [19]

Schmidt

[11] Patent Number: 4,688,366

[45] Date of Patent: Aug. 25, 1987

[54] THERMAL BARRIER HOLLOW OR CONSTRUCTION ELEMENT

[75] Inventor: Dietrich F. Schmidt, Etters, Pa.

[73] Assignee: Capitol Products Corporation, Mechanicsburg, Pa.

[21] Appl. No.: 889,242

[22] Filed: Jul. 25, 1986

[51] Int. Cl.[4] ..... E04C 3/30

[52] U.S. Cl. ..... 52/731; 52/309.13; 264/261; 264/263; 49/DIG. 1

[58] Field of Search ..... 52/730, 731, 404, 309.1; 264/46.5, 46.7, 261, 263; 49/DIG. 1

[56] References Cited

U.S. PATENT DOCUMENTS

| | | | |
|---|---|---|---|
| 3,556,917 | 1/1971 | Eakin | 264/46.5 |
| 4,185,439 | 1/1980 | Bischipp | 264/261 |
| 4,581,089 | 4/1986 | MacMillan | 264/261 |

FOREIGN PATENT DOCUMENTS

| | | | |
|---|---|---|---|
| 313279 | 1/1985 | European Pat. Off. . | |
| 146529 | 6/1985 | European Pat. Off. | 52/405 |
| 2531221 | 2/1977 | Fed. Rep. of Germany | 49/DIG. 1 |
| 2831573 | 1/1980 | Fed. Rep. of Germany | 52/730 |
| 3107725 | 6/1982 | Fed. Rep. of Germany . | |
| 132336 | 10/1979 | Japan | 52/730 |
| 2060750 | 5/1981 | United Kingdom | 49/DIG. 1 |
| 2074222 | 10/1981 | United Kingdom . | |
| 2123468 | 2/1984 | United Kingdom . | |

*Primary Examiner*—Henry E. Raduazo

*Attorney, Agent, or Firm*—Donald L. Johnson; John F. Sieberth; Paul H. Leonard

[57] ABSTRACT

A dual thermal barrier hollow comprised of separate metal shapes joined together with a non-conductive adhesive tape and a thermal barrier material.

13 Claims, 3 Drawing Figures

THERMAL BARRIER HOLLOW OR CONSTRUCTION ELEMENT

BACKGROUND OF THE INVENTION

The present invention relates to a unitary construction element or hollow having a dual thermal barrier or thermobreak therein, commonly referred to as a thermal barrier extrusion, which can be employed in construction of windows, doors, frames therefor, and the like.

The invention especially relates to dual thermal barrier hollows wherein the thermal barrier material is poured into a receiving channel or area in an extrusion.

The invention particularly relates to a dual thermal barrier hollow or unitary construction element wherein two separate aluminum solid extrusions are joined together by a poured polyurethane resin or the like to form a single dual thermal barrier hollow.

With the advent of metal construction used in making windows, doors, frames therefor, curtain walls and the like, problems of heat conduction and water condensation have arisen. The use of aluminum or other metals has caused a greater transfer of heat between wall elements than had heretofore taken place in earlier types of construction. To solve this problem, some type of insulating or thermal break construction is essential. Accordingly, a variety of thermal barrier or thermobreak constructions and methods and apparatuses for making such constructions have been developed.

One type of construction which has achieved some degree of success is one in which the insulating material is poured, flowed, foamed, or formed in place. U.S. Pat. Nos. 3,204,324; 3,332,170; 3,393,487; 3,624,885 (U.S. Pat. Nos. Re. 28,084 and Re. 28,086); 3,634,565; and 3,823,524 are illustrative of such types of construction. Of these, U.S. Pat. No. 3,204,324 is representative of a method of making a thermal barrier construction element or insulating construction, wherein a metal shape having a generally U-shaped channel therein is filled with a flowing resinous insulating composition; the composition is cured, and subsequently a portion of the metal member or web forming the base of the channel is removed. U.S. Pat. No. 3,823,524 relates to a similar method but employs a web member which extends convexly between the structural member forming the channel. Both of these methods require the use of a liquid resinous composition which is subsequently cured or hardened. U.S. Pat. No. 3,393,487 discloses a somewhat more complicated process for making a thermal insulating joing construction and also utilizes a liquid plastic material. In such process, two separate elongated metal shapes are spaced apart and fastened together with a solid first insulating member. The two shapes and the first insulating member provide a channel in which a second thermal insulating member is flowed therein. Upon solidification of the latter, the metal and insulating members are locked together as an integral unit.

Of the more common types of thermal barrier constructions, two metal members are joined together by a solid insulating member. These constructions encompass a wide variety of insulating and/or plastic shapes and metal shapes. Illustrative of these are U.S. Pat. Nos. 2,835,360; 3,093,217; 3,099,337; 3,289,377; 3,436,884; 3,487,580; 3,600,857; and 3,916,503. In one of the more basic of this type of construction, for example, in U.S. Pat. No. 2,835,360, two metal members are joined together and spaced apart by an overlapping insulating member. In U.S. Pat. No. 3,916,503, simple mechanical means are employed to join the metal members with an insulating member. U.S. Pat. No. 3,600,857 is representative of more complex shapes of insulating and metal members.

In a particular type of the foregoing more common type of thermal barrier constructions, metal and insulating members are mechanically joined together by deformation of the metal members or by crimping or stitching the metal members on the insulating member. Representative of such a joining method are U.S. Pat. Nos. 3,114,179; 3,411,995; 3,420,026; 3,517,472; and 3,903,217 and Swiss Pat. No. 320,988 (same as British Pat. No. 768,499). For example, U.S. Pat. No. 3,420,026 discloses several types of thermal insulating members and methods of making them. In one type, two separate metal members are mechanically joined to a central insulating member by crimping or deformation of groove means or projections on the metal members. In one particular type of thermal break construction, the insulating member is in the shape of a Maltese cross in cross-section. In another embodiment, the insulating member is made from a thermoplastic material and a portion thereof is heated to cause melting and flow of the plastic into an associated groove means formed by the two metal members. Upon cooling of the plastic, the metal and plastic members are unitarily joined together. U.S. Pat. No. 3,517,472 also illustrates a mechanical joining process similar to that of the former and additionally represents the use of a plastic or insulating member which expands upon heating. The Swiss patent discloses several types of window or door frames, one of which employs a crimp system using two separate metal extrusions having a pair of flanges thereon which form grooves for receiving a plastic rod. After the plastic rod or thermal barrier member is introduced into the grooves, the flanges are pressed towards the plastic rod or crimped thereon so that they are flush with the sides of the rod.

Other types of thermal break or insulated window or wall constructions are illustrated by U.S. Pat. Nos. 2,654,920; 3,055,468; 3,289,377; 3,411,254; and 3,446,801. For example, U.S. Pat. No. 3,411,254 provides a plastic thermobreak which utilizes a plastic locking strip which contains a heat actuated blowing agent to join two separate metal shapes. After assembly of the two metal shapes and the plastic strip, the unit is heated to expand the plastic into tight engagement with the two metal members.

More recent types of thermal barrier construction methods are illustrated by U.S. Pat. Nos. 3,815,216; 3,916,503; 3,925,953; 3,992,769; 4,079,496; 4,151,682; and 4,188,705.

U.S. Pat. No. 3,815,216 employs a metal extrusion which has a removable interior section which is subsequently removed to separate the extrusion into two metal members. While maintaining the separate metal members spaced apart, a plastic material is inserted therebetween. The construction element can be made in a continuous operation.

In U.S. Pat. No. 3,916,503, lineal shapes are extruded to accept an insulating barrier previously formed in such a shape as to fit the lineal shapes. The insulating barrier is joined with the lineal shapes by mechanical means.

U.S. Pat. No. 3,925,953 discloses a method wherein two metal members are joined together by a plastic clamp and held apart by a plastic wedge.

U.S. Pat. No. 3,992,769 describes a method wherein a metal shape is extruded in a normal manner and the insulating member is crimped in position in the metal extrusion and a portion of the metal extrusion is subsequently removed.

U.S. Pat. No. 4,079,496 discloses a method wherein a pair of lineal metal shapes are aligned in a spaced apart relation and the insulating member has small lineal projection thereon which are shaved off to provide a tight or interference fit, when the insulating member is inserted between the metal shapes so as to join them together.

U.S. Pat. No. 4,151,682 discloses a thermal barrier window construction wherein centered rigid extended plastic shapes are included in the window frame.

U.S. Pat. No. 4,188,705 illustrates a crimping or stitching apparatus. In such a crimping system, rollers are normally used to provide crimping of the metal flanges on the insulating or plastic member. Conventionally, two rollers or wheels are required to crimp the flanges. One roller bends the metal flanges on the insulating member while the other roller backs up or holds the metal extrusion in the correct position for joining metal and plastic members. To accomplish the crimping action, clear access must be available on both sides of the plastic member on which crimping of the metal members occurs. In some cases, a small wheel or support is laterally employed to serve as a back-up. The size of the support and the forces required to obtain a tight joint create a number of operating problems. The types of shapes or extrusions which can be used in this method are limited.

Large window shapes such as mullions, rails and sills used in thermally insulated windows often require two separate thermal barriers to maintain structural integrity. The present invention provides hollow shapes which cannot be readily debridged or separated because of their geometry.

The present invention provides a number of advantages over prior art constructions namely in that solid extruded shapes are quickly and easily joined together to form a poured urethane dual thermal barrier construction element having structural integrity.

It is a primary object of the instant invention to provide a relatively simple dual thermal barrier hollow utilizing solid lineal shapes or extrusions.

Other objects and advantages of the present invention will become more readily apparent from a consideration of the description and drawings hereinafter.

SUMMARY OF THE INVENTION

Dual thermal barrier hollows or construction elements comprise a pair of separate aluminum or metal solid shapes joined together with a non-conductive adhesive tape and poured polyurethane or other suitable plastic in a receiving area or channel formed by the joining of the metal members.

DESCRIPTION OF THE PREFERRED EMBODIMENTS

Figure 1:
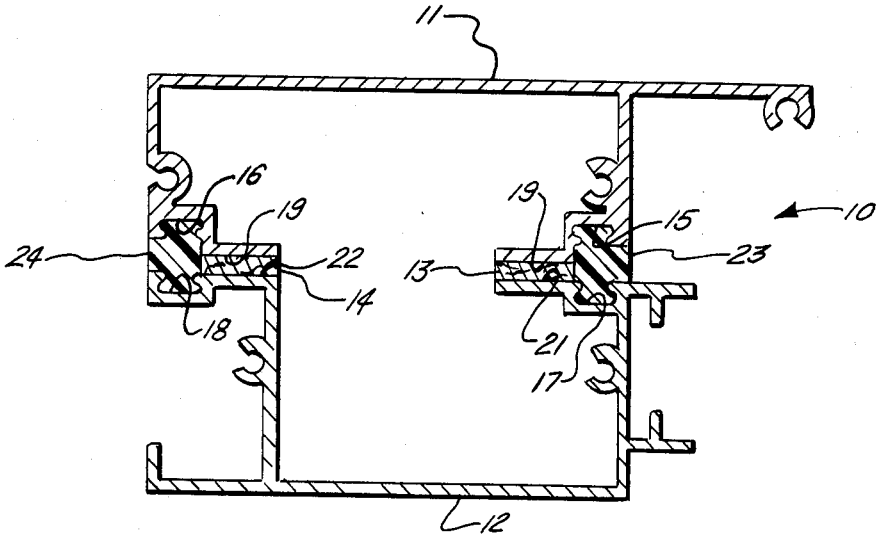
FIG. 1 is a view in cross-section illustrating a lineal dual thermal barrier hollow of the invention.

Referring now to the drawings, FIG. 1 illustrates a preferred embodiment of the dual thermal barrier hollow 10 of the invention. Two solid lineal shapes or extrusions 11 and 12 which were prepared in a customary manner are joined together by nonconductive dual faced adhesive tapes 13 and 14. Although the shapes may be of a variety of configurations, it is important though that they be so constructed that they can be joined together as illustrated.

Exterior sill or lineal shape 11 is permanently affixed to a matching interior sill or lineal shape 12. Each of the shapes of the hollow is somewhat rectangularly shaped in cross-section with one side of the rectangle open so that when the two shapes are placed adjacent each other as shown in FIG. 1, a hollow 10 is formed.

The exterior sill 11 has thermal barrier receiving channels 15 and 16 on each side thereof. The interior sill 12 also has thermal barrier receiving channels 17 and 18 on each side thereof. Adjacent each channel 15 and 16 and interiorly thereof of each, is a tape receiving surface or edge 18 and 19, respectively. Adjacent each channel 17 and 18 and interiorly thereof of each, is a tape receiving surface or edge 21 and 22, respectively.

Shapes 11 and 12 are attached to each other by means of the dual faced non-conductive adhesive tapes 13 and 14. An adhesive backed cellular neoprene tape is preferred, but any other similar tape may be used. Tape thickness is preferably identical to the thermal barrier thickness, i.e. separation of inside to outside metal. The tape itself offers no structural integrity of the hollow, but does provide the means to hold the two shapes together before they are permanently joined to each other and after joining enchances the dual thermal barriers.

As readily seen, members 11 and 12 form the hollow 10 and the smaller channels 15 and 17 and tape 13 form the larger channel which contains the cured resin or poured polyurethane thermal barrier 23 and smaller channels 16 and 18 and tape 14 form the larger channel which contains the cured resin or polyurethane thermal barrier 24. A poured polyurethane is especially preferred as the thermal barrier material as it not only binds the two shapes 11 and 12 together, but also provides structural integrity to the hollow 10. The thermal barrier material should be equal to the interrupted metal wall in strength.

The hollow or construction element of the invention can be constructed of a variety of shape configurations with proper location of tape surfaces and channels.

Figure 2:
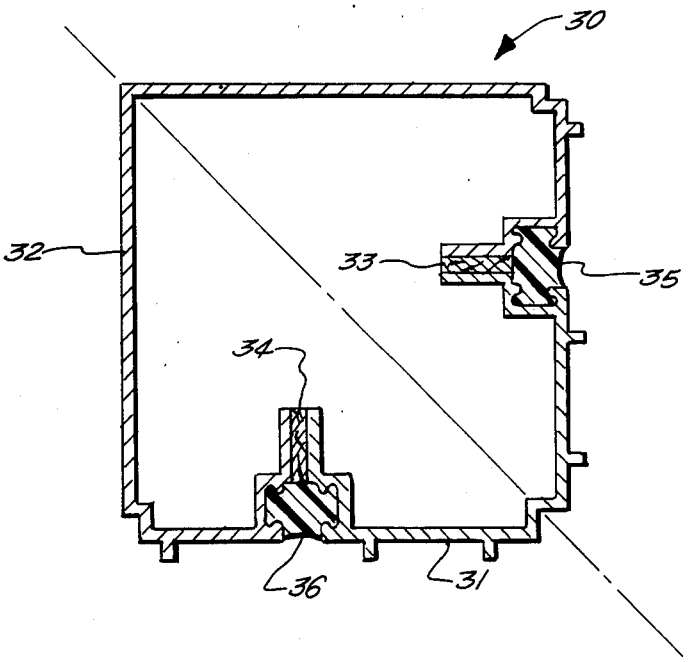
FIG. 2 is a view in cross-section of a lineal dual thermal barrier hollow illustrating an alternate embodiment of the invention.

The invention is preferably made from aluminum extrusions, but can be made of other materials, e.g. rolled steel. The invention is especially useful in constructing windows and doors FIG. 2 illustrates a corner mullion of this invention. Hollow 30 is made up of an interior mullion 31 and an exterior mullion 32. Assemblying non-conductive adhesive tapes 33 and 34 and poured thermal barrier plastics 35 and 36 provide the dual thermal barrier of the hollow 30.

The present invention provides dual thermal barrier hollows of a variety of configurations as desired.

Figure 3:
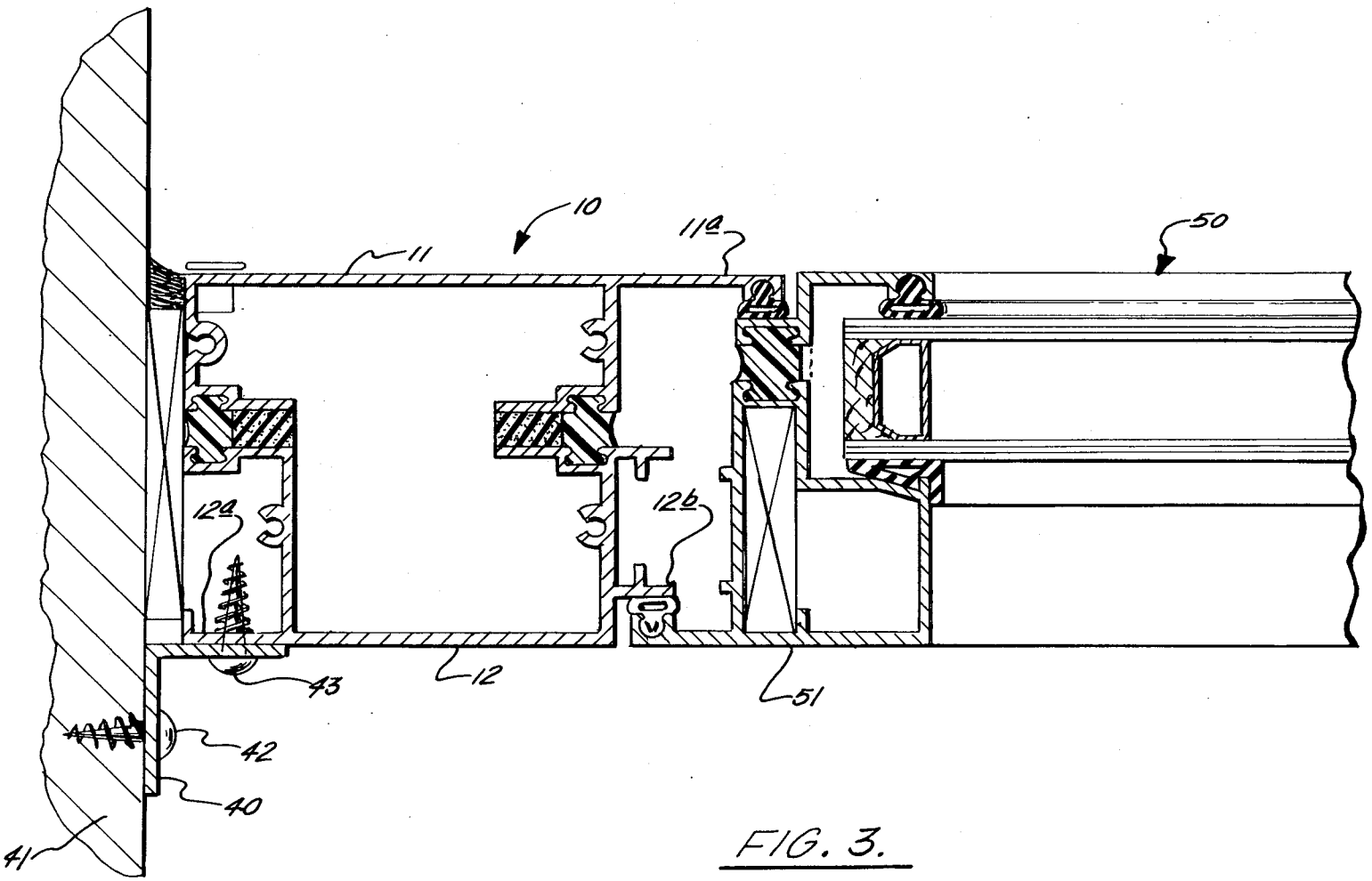
FIG. 3 is a view in cross-section illustrating the dual thermal barrier hollow or construction element of the invention as assembled in a casement window frame.

Referring now to FIG. 3, the hollow 10 with exterior sill member 11 and interior sill member 12 is illustrated as a sash in a casement window frame construction. The hollow 10 is mounted to the wall in a customary manner. Angle member 40 is attached to wall 41 at appropriate intervals by means of wood screws 42 or other suitable attachment means. An end leg 12*a* of the member 12 is attached to the angle member 40 by means of metal screws 43 or other suitable means.

Window 50 is so constructed that leg 11*a* and leg 12*b* provide suitable stops for window frame 51. The other side of the window (not shown) is similarly constructed.

It can readily be appreciated that a wide variety of window constructions are possible. Each window frame assembly though must have a dual thermal break mullion or hollow.

The foregoing disclosure and description of the invention is only illustrative and explanatory thereof and various changes in the size, shape and materials, as well as in the details of the illustrated construction or procedure, may be made within the scope of the appended claims without departing from the spirit of the invention.

What is claimed is:

1. A dual thermal barrier lineal metal hollow comprising a pair of metal shapes adjacent each other in a spaced apart relationship, each of said metal shapes having a pair of spaced apart thermal barrier receiving channels and a tape receiving surface adjacent to and interiorly of each channel; attached to each of the two metal shapes is a non-conductive dual faced adhesive tape placed on a tape receiving surface of each of the metal shapes, the shapes being so positioned with respect to each other that a thermal barrier receiving channel of one shape is adjacent a thermal barrier receiving channel on the other shape and that the two thermal barrier receiving channels together and the tape adjacent thereto form a larger thermal barrier receiving channel, and thereby form two larger thermal barrier receiving channels spaced apart from each other; a thermal barrier material substantially filling each of the larger thermal barrier receiving channels thereby forming a dual thermal barrier hollow having structural integrity.

2. The hollow of claim 1, wherein the metal shapes are aluminum extrusions.

3. The hollow of claim 1, wherein the metal shapes are constructed of rolled steel.

4. The hollow of claim 1, wherein the non-conductive adhesive tape is a dual faced adhesive backed cellular neoprene tape.

5. The hollow of claim 1, wherein the thermal barrier material is a poured polyurethane.

6. The hollow of claim 1, wherein one metal shape is an interior sill and the other metal shape is an exterior sill.

7. The hollow of claim 1, wherein the hollow is substantially rectangularly shaped and the thermal barrier channels are directly opposite each other.

8. The hollow of claim 1, wherein the hollow is substantially rectangularly shaped and the thermal barrier channels are positioned on sides of the rectangle adjacent each other.

9. The hollow of claim 1, wherein the hollow is a corner mullion.

10. The hollow of claim 1, wherein the hollow is a window frame member of a casement window.

11. The hollow of claim 1, wherein the tape receiving surfaces adjacent to and interiorly of each thermal barrier receiving channel form a smaller channel adjacent to and interiorly of each thermal barrier receiving channel for receiving the non-conductive dual faced adhesive tape.

12. The hollow of claim 11, wherein the tape receiving surfaces are parallel to each other and spaced apart therefrom.

13. The hollow of claim 12, wherein the tape receiving surfaces are sufficiently spaced apart from each other to provide a complete thermal barrier.

* * * * *